United States Patent [19]

Gibson

[11] Patent Number: 4,607,667

[45] Date of Patent: Aug. 26, 1986

[54] APPARATUS FOR SEVERING INSERTED FILLING YARNS

[75] Inventor: Carroll A. Gibson, Rocky Mount, N.C.

[73] Assignee: Texfi Industries, Inc., Rocky Mount, N.C.

[21] Appl. No.: 646,856

[22] Filed: Sep. 4, 1984

[51] Int. Cl.[4] ..... D03D 47/34

[52] U.S. Cl. ..... 139/429; 139/302

[58] Field of Search ..... 139/425, 446, 450, 302, 139/303, 429

[56] References Cited

U.S. PATENT DOCUMENTS

| | | | |
|---|---|---|---|
| 3,410,316 | 11/1968 | Giuttari | 139/302 |
| 3,744,533 | 7/1973 | Yano et al. | 139/302 |
| 4,054,159 | 10/1977 | Juillard | 139/450 |
| 4,275,773 | 6/1981 | Shibata | 139/429 |

*Primary Examiner*—Henry S. Jaudon

*Attorney, Agent, or Firm*—Bell, Seltzer, Park & Gibson

[57] ABSTRACT

In a loom of the type wherein the filling yarn is inserted into the warp shed in the form of cut lengths and wherein a reed serves for beating-up the inserted filling yarn into the fabric at the fell of the cloth, the combination therewith of improved means for severing the terminal ends of filling yarns projecting outwardly from at least one of the selvages of the fabric being woven; which improved means comprises positioning a cutter adjacent at least one end of the reed, and providing a relatively wide widthwise extending opening in the reed adjacent the end where the cutter is positioned, with the opening being of a width substantially greater than the dent spacing of the reed; so that when the reed is reciprocated in beating-up the filling yarn into the fabric, the cutter has portions thereof that are positioned in the opening in the reed for severing the terminal ends of the filling yarn close to the selvage of the fabric being woven.

7 Claims, 5 Drawing Figures

APPARATUS FOR SEVERING INSERTED FILLING YARNS

The present invention relates to the cutting of filling yarn ends in looms of the type wherein the filling yarns are inserted into the warp shed in the form of cut lengths, so that the ends are cut close to the selvage of the fabric being woven.

As is known to those familiar with the formation of textile fabrics, recently developed textile fabric forming machines, and particularly certain shuttleless looms, insert individual cut lengths of filling yarns into sheds formed of warp yarns and produce fabrics which have fringed or rough appearing edges of filling tails along one or both longitudinal side edges. Where fabric is woven on such a shuttleless loom, both ends of the yarn already inserted are cut by a suitable cutting device after every filling insertion, leaving the terminal ends of the cut yarn to hang down out of the selvage of the woven fabric. These terminal ends are rough, and if not handled properly, can become folded-in, can cause damaged selvage, and can lessen the cutability and other qualities of the finished fabric.

As the commercial use of shuttleless looms has grown, efforts have been made to develop arrangements and methods for producing smoother side edges along the fabrics produced. Sharp blades, knives or scissoring devices have been mounted for cutting or trimming inserted yarns. Alternatively, other devices known as "hot wires" have used heated elements to sever thermoplastic yarns. Hot wire cutters are especially desirable for severing synthetic yarn composed of twisted thermoplastic fibers. Such fibers are difficult to mechanically shear cleanly and they also, when cut tend to untwist and unravel because of "plastic memory."

Although cutting devices using hot wires exhibit particular advantages in certain applications, they likewise exhibit certain disadvantages. In particular, in order to protect hot wire cutters from mechanical failure, attachments known as "reed protectors" have been positioned on the loom frame or on the reed. Although reed protectors offer some protection, such devices likewise present their own disadvantages. For example, in some of the typical commercially practiced prior art, and as illustrated in the drawings to be described later herein, the reed protectors comprise U-shaped brackets. The web of each of the brackets is positioned against the reed and the legs extend from the reed towards the yarn cutters. During operation, the inserted filling yarn spans the legs of each bracket. As the reed beats up the inserted filling yarn into the fabric, its stroke carries it to a point at which the hot wire cutters are each received between the legs of the respective protector bracket positioned opposite thereto, allowing the cutters to make contact with and thermally sever the inserted filling yarn spanning the bracket if all elements are properly aligned and adjusted. At the same time, the web of the bracket is intended to prevent the hot wire from coming into contact with the frame of the reed, which may comprise a nonmetallic material which could otherwise be damaged by such contact.

While providing protection to the reed, these devices nevertheless require that a length of filling yarn be carried across the reed protector in order to present the filling yarn for cutting. The filling yarn thus must extend outwardly from the fabric far enough to reach the protector or guide bar. The resulting cut fabric has the undesirable filling tails alluded to earlier which have a substantial undesired influence on the quality and cutability of the finished cloth. For example, a filling yarn which extends far enough from a finished cloth to extend around a reed protector will exhibit a minimum tail length of ¼" in the finished, cut fabric.

Additionally, when the hot wire cutter moves out of precise alignment with the reed protector, which eventually inevitably happens as a result of the continuous shaking motion of the loom, damage may result to the hot wire or the reed or reed protector as well. Finally, the presence of reed protectors complicates the setting of the hot wire cutters to such desired aligned positions and makes the setting much more critical.

The present invention is directed towards providing an apparatus for severing inserted filling yarns which has no wearing parts against the reed, which provides filling tails on the finished fabric of a minimum length, and which also provides greater protection for the reed and for the yarn cutter, and more accurate and easier adjustment of the yarn cutter.

The present invention provides the combination of a loom of the type wherein the filling yarn is inserted into the warp shed in the form of cut lengths and wherein a reed serves for beating up the inserted filling yarns into the fabric at the fell of the cloth, with improved means for severing the terminal ends of filling yarns projecting outwardly from the selvages of the fabric being woven. The improved means comprises a cutter positioned adjacent at least one end of the reed, with the reed having a relatively wide widthwise extending opening therein adjacent the end where the cutter is positioned, with the opening being of a width substantially greater than the dent spacing of the reed. This cutter can be a resistance heater or hot wire cutter and there are provided means mounting the cutter relative to the opening such that when the reed is reciprocated in beating up the filling yarn into the fabric, the cutter has portions that are positioned in the opening in the reed for severing the terminal ends of the filling yarn close to the selvage of the fabric being woven, desirably within about 1/32" of the selvage.

These and other objects and advantages of the invention will become apparent from a reading of the following specification and claims, together with the accompanying drawings, wherein like parts are referred to and indicated by like reference characters and wherein:

Figure 2:
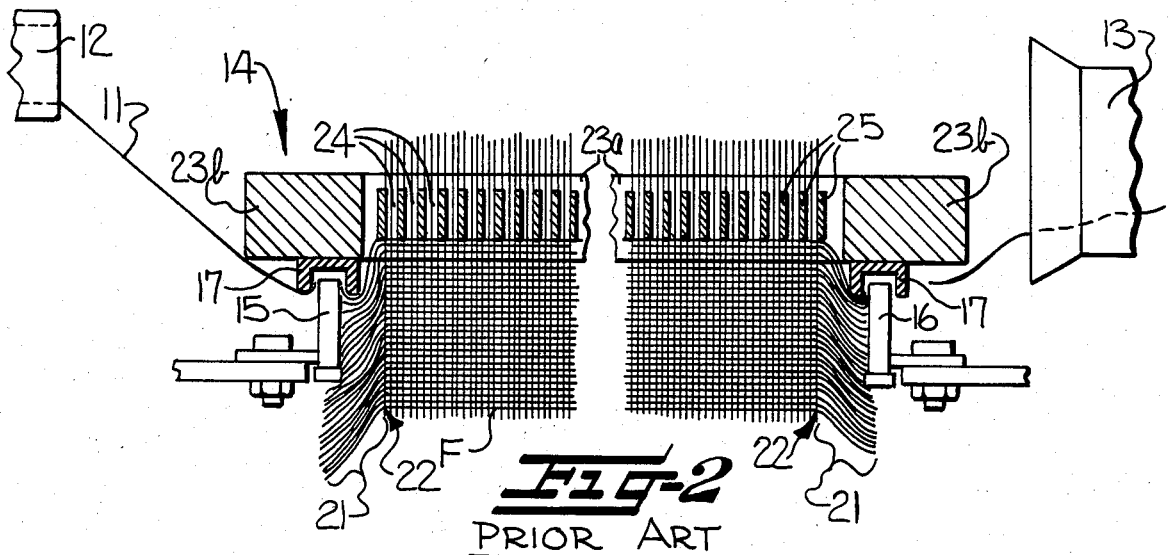
Fig-2 PRIOR ART
FIG. 2 is a schematic cross-sectional view of the prior art showing a reed and heat resistance cutters and reed protectors positioned at opposite ends of the reed and taken from a view along the top of the reed.
Figure 3:
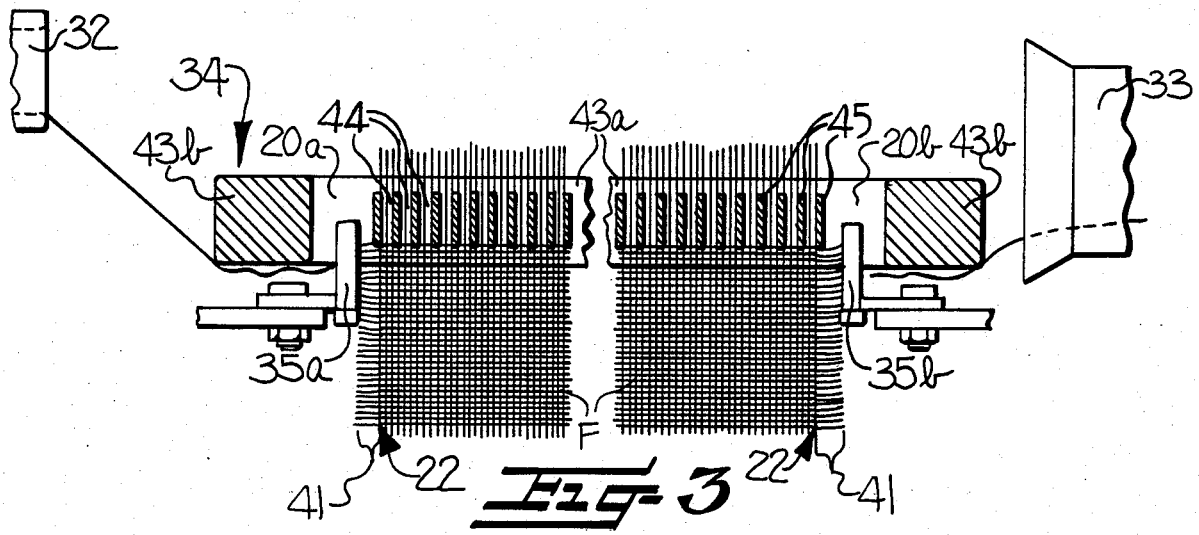
FIG. 3 is a schematic cross-sectional view taken along the top of a reed of the present invention and showing the combination thereof of the reed and cutters which make up the present invention.
Figure 4:
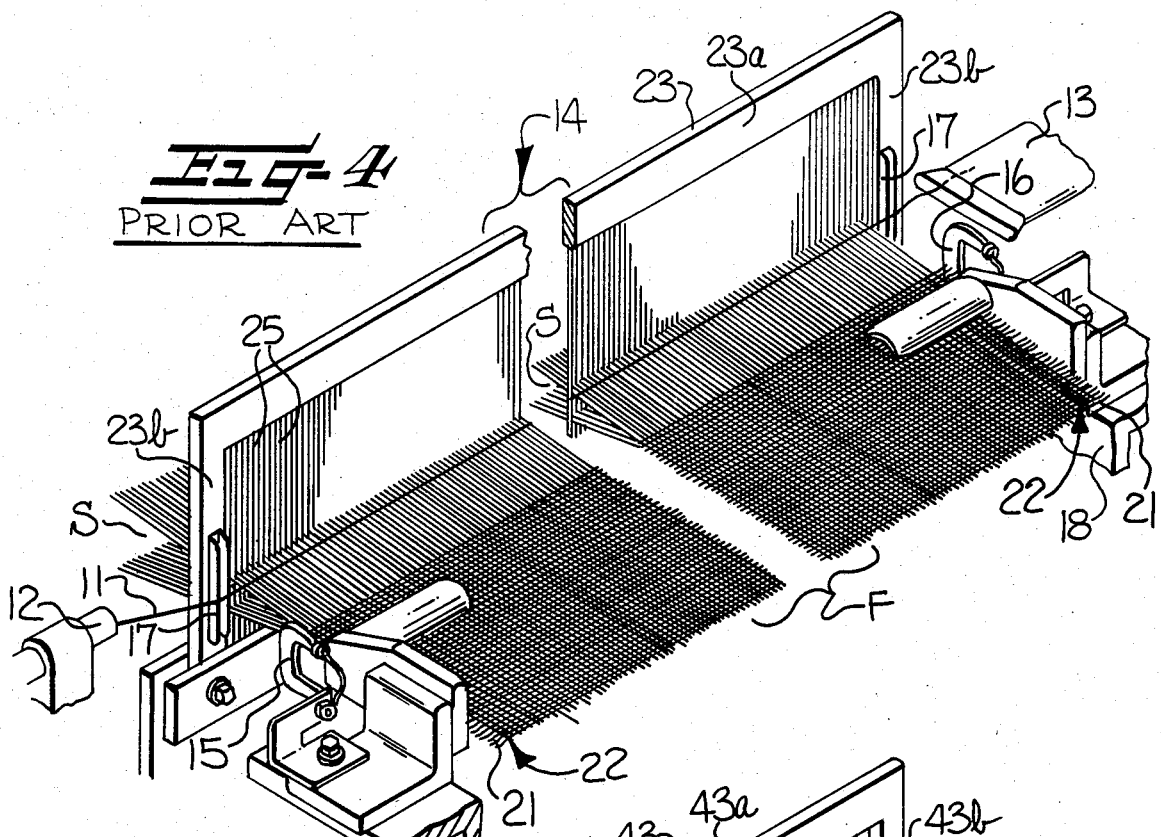
FIG-4 PRIOR ART
FIG. 4 is a schematic perspective view of the prior art showing a reed, a pair of reed protectors, and a pair of heat resistance cutters all positioned on a loom.
Figure 5:
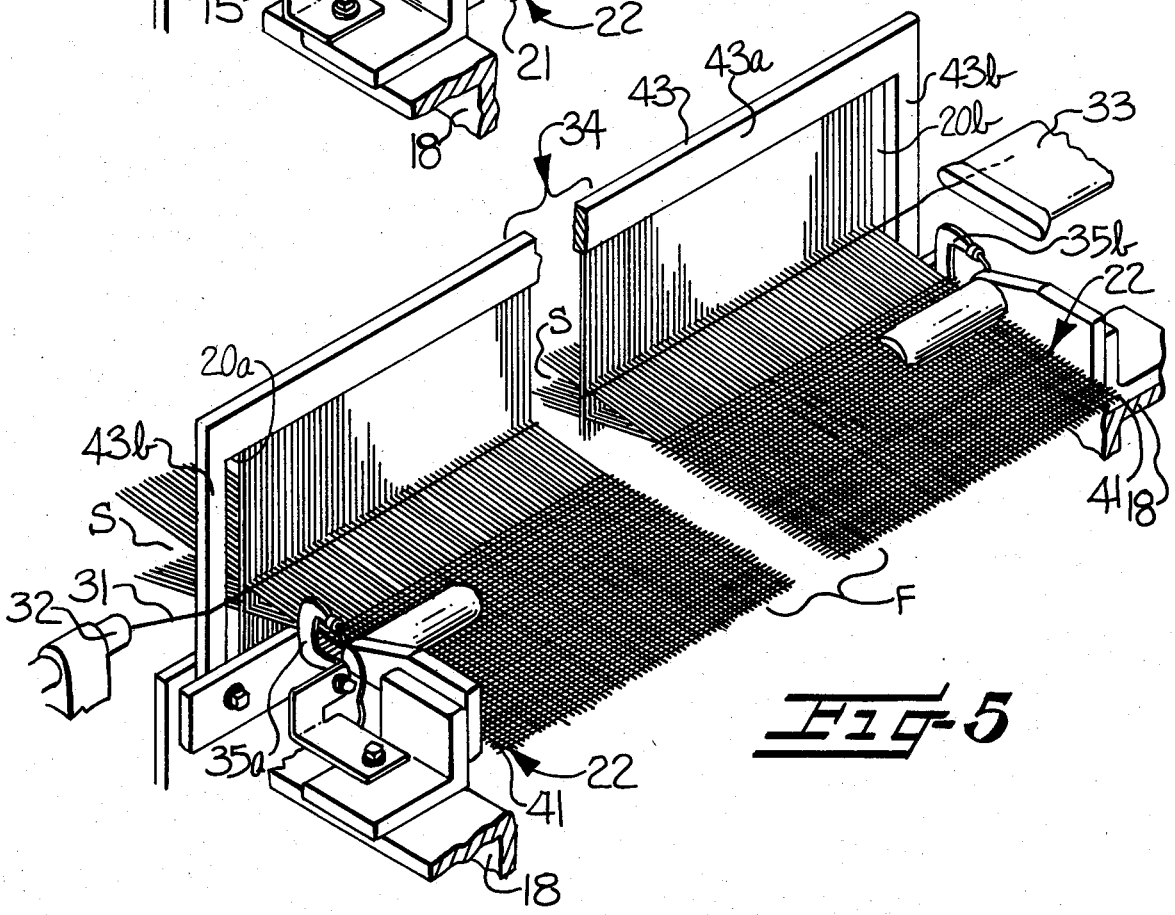
FIG. 5 is a schematic perspective view of the present invention showing the reed and the heat cutters associated therewith.

As illustrated in the drawings, FIGS. 2 and 4 show typical applications of the commercially practiced prior art, while FIGS. 3 and 5 show the apparatus of the present invention.

As best illustrated by FIG. 4, in the weaving operation provided by shuttleless looms, a cut length of yarn indicated at 11 in FIG. 4 is projected from a projecting means 12 into the shed S of the warp yarns and is projected entirely through the warp shed and into a receiving means on the other side of the loom, shown in the form of a suction means 13 which receives and positions the projected end of the cut length of filling yarn.

As in most weaving operations, a reed broadly designated at 14 in the prior art showings of FIGS. 2 and 4 serves for beating up the inserted filling yarns into the fabric F at the fell of the fabric. The reed 14 comprises a frame 23 having horizontal portions 23*a* and vertical portions 23*b*, and a series of spaces or dents 24 defined by the comb teeth 25 of the reed which are also sometimes themselves referred to as "dents." Hereinafter, however, "dent" will refer exclusively to the spaces between the comb teeth. As known to those familiar with the art and as illustrated in FIGS. 2–5, the warp yarns pass through the dents during the weaving cycle.

Although the operation of shuttleless looms is such that the filling yarns are inserted as cut lengths, the distance that the projected yarn 11 must cover in order to be projected across the warp yarns through the shed from the projecting means and to the receiving means, requires a length of cut yarn which substantially exceeds the length of filling yarn required to form the woven fabric. Consequently, at some point in the weaving cycle, the filling yarns must be cut again, closer to selvage 22 of the finished woven fabric F. Such cutting is generally accomplished either just before a reed beats up the filling yarn, just as the reed is beating up the filling yarn, or after the yarn has been beaten up into the fabric.

As best illustrated in FIG. 2, in one manner of commercially practiced prior art cutting, resistance heaters 15 are mounted on a loom frame 18 in such a position that when the reed 14 beats up the inserted filling yarn 11 against the fell of the woven fabric F, the cutters 15 will come in contact with and sever the filling yarn 11. As further shown in FIG. 2, in order to protect the reed 14 from the cutters 15 and to position the filling yarn for cutting, reed protectors 17 are positioned on the vertical portions 23*b* of the reed frame such that during weaving, the inserted filling yarn 11 passes from the projecting means 12 past and across the legs of the near reed protector 17, through the shed S of the warp yarns, past and across the legs of the reed protector 17 on the opposite side of the loom 10 and finally into the receiving means 13.

As illustrated in FIG. 2, because the inserted filling yarn must extend from both selvages of the fabric, and to and across each of the respective reed protectors 17 before it can be cut, an excess length of filling yarn sufficient to reach the reed protectors 17 and the cutters 15 from the beat up fell of the fabric must be provided at either end of the inserted filling yarns 11. After cutting takes place between the respective legs of the reed protectors 17, there thus necessarily exists on either side of the woven fabric an outwardly extending excess segment or "tail" of the inserted filling yarn. In typical applications, such "tails", designated at 21 in FIGS. 2 and 4, extend outwardly for about ¼" or more on both sides of the woven fabric. These tails raise problems of potential folding in, flawed selvage and lowered cutability in the woven fabric. Because all of these problems can be related to the tails which remain on the woven fabric after cutting, a reduction in tail length can result in a corresponding increase in the qualities of finished woven fabric and a decrease in problems associated with further weaving and handling of the finished woven fabric.

Figure 1:
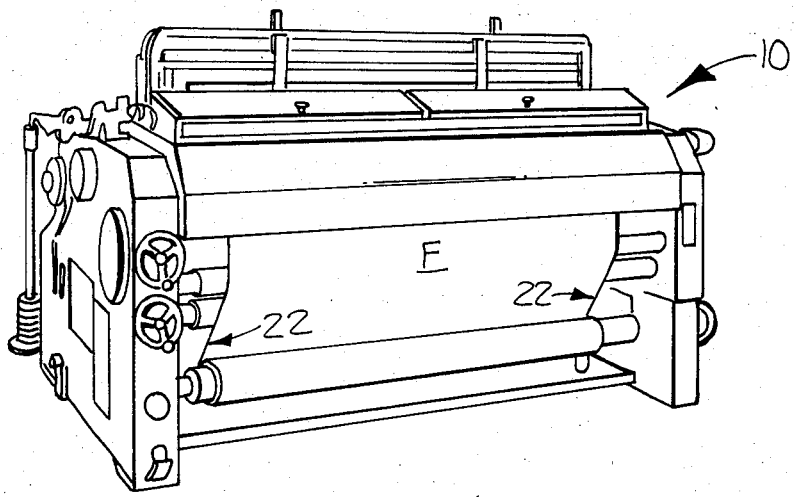
FIG. 1 is an illustration of a shuttleless loom of the type for which the present invention is adapted to be used.

In the present invention illustrated in FIGS. 1, 3 and 5, a loom 10 has a modified reed 34 which likewise comprises a frame 43 with horizontal and vertical portions, 43*a* and 43*b* respectively, and dents and teeth 44 and 45 respectively, but otherwise also includes a number of modifications to be described hereinafter.

As best illustrated by FIG. 5, in a weaving operation on a shuttleless loom including the present invention, a cut length of yarn indicated at 31 in FIG. 5 is likewise projected from a projecting means 32 into the shed S of the warp yarns and is projected entirely through the warp shed and into a receiving means on the other side of the loom, shown in the form of suction means 33 which receives and positions the projected end of the cut length of filling yarn.

As best illustrated in FIGS. 3 and 5, the present invention is directed towards an improved means of severing these terminal ends and for solving the problems associated therewith. As best seen in FIG. 5, there is provided a reed 34 which extends widthwise beyond the positions of cutters 35*a* and 35*b*. There are also provided relatively wide widthwise extending openings 20*a* and 20*b* at the respective ends of the reed 34 adjacent the ends where the cutters 35*a* and 35*b* are positioned, with the openings each being of a width substantially greater than the dent spacing 44 of the reed 34.

Additionally, cutters 35 are mounted relative to the widthwise extending openings 20*a* and 20*b* in the reed 34 such that when the reed is reciprocated in beating up the filling yarn into the fabric, the cutters 35*a* and 35*b* have portions thereof that are positioned in the openings 20*a* and 20*b* respectively in the reed 34 for severing the terminal ends 41 of the filling yarn 31 close to the selvage of the fabric. The position of the cutters relative to the reed and the openings therein is best illustrated in the perspective view of FIG. 5.

The operation and advantageous results of the invention are best shown in FIG. 3. FIG. 3 represents a point in the weaving cycle at which the reed 34 has just reciprocated and beat up an inserted filling yarn 31 just after the point at which the cutters 35*a* and 35*b* have severed the respective ends of the yarn 31. It will thus be seen from FIG. 3 that the combination of the widthwise extending openings 20*a* and 20*b* in the reed 34 and the positioning of the cutters 35*a* and 35*b* which allows portions thereof to extend into the openings 20*a* and 20*b* in the reed 34, to permit cutting to take place there rather than across the legs of the reed protectors 17 of the prior art. Because the cutters are no longer positioned adjacent the vertical portions 43*b* of the frame 43 of the reed 34, but are now positioned to move into the openings 20*a* and 20*b* in the reed 34, the reed is now protected from the cutter by the spaced apart relation therewith. Reed protectors 17 may be eliminated.

In preferred embodiments of the invention, the cutters 35*a* and 35*b* are desirably mounted at each end of reed 43 and comprise resistance heaters which are preferred for severing certain types of yarns, particularly thermoplastic yarns. In such preferred embodiments, the widthwise extending openings 20*a* and 20*b* in the reed 34 are about 4.5 mm inches in width or a width substantially equivalent to about 2½ of the typical dent spaces 44 in the remainder of the reed. In operation of the preferred embodiment, the terminal ends of the filling yarns being woven may be severed within about 1/32nd of an inch of the selvage of the fabric being woven. With respect to prior art practices, this represents at least a fourfold improvement in the selvage length as the use of reed protectors resulted in terminal ends of the inserted filling yarns in the finished woven fabric of at least ¼ of an inch or more.

Permitting the cutter 35 to pass through the vertical plane of the reed during the cutting operation and providing a relatively wide widthwise area for the cutter to effect cutting therein, allows the cutter to operate with much greater freedom of action than before with much less danger of striking the reed 34 or reed protector 17 and damaging same or damaging the cutter 35.

At the same time, the present invention provides a means for severing the inserted filling yarns much closer to the selvage of the fabric than had previously been the case.

Fabric woven on a shuttleless loom utilizing the present invention is thus characterized by shorter terminal ends, fewer terminal ends being folded into the fabric, increased cutability and an increase in other beneficial qualities of the finished woven fabric.

The foregoing embodiments are to be considered illustrative, rather than restrictive of the invention, and those modifications which come within the meaning and range of equivalence of the claims are to be included therein.

That which is claimed is:

1. In a loom of the type wherein the filling yarn is inserted into the warp shed in the form of cut lengths and wherein a reed serves for beating-up the inserted filling yarn into the fabric at the fell of the cloth, the combination therewith of improved means for severing the terminal ends of filling yarns projecting outwardly from at least one of the selvages of the fabric being woven;

said means comprising a cutter positioned adjacent at least one end of the reed, said reed having a relatively wide widthwise extending opening therein adjacent the end where said cutter is positioned, said opening being of a width substantially greater than the dent spacing of the reed; and means mounting said cutter relative to said opening so that upon the reed being reciprocated in beating-up the filling yarn into the fabric, said cutter has yarn severing portions that are positioned in said opening in the reed during the effecting of severing of the terminal ends of the filling yarns so that the terminal ends of the filling yarn are severed within about 1/32" of the selvage of the fabric being woven.

2. A loom according to claim 1 wherein said cutter comprises a resistance heater.

3. In a loom of the type wherein the filling yarn is inserted into the warp shed in the form of cut lengths and wherein a reed serves for beating-up the inserted filling yarn into the fabric at the fell of the cloth, the combination therewith of improved means for severing the terminal ends of filling yarns projecting upwardly from at least one of the selvages of the fabric being woven;

said means comprising a cutter positioned adjacent at least one end of the reed, said reed having equally spaced dents and a widthwise extending opening therein adjacent the end where said cutter is positioned, said opening being of a width substantially equivalent to two and a half dent spaces; and means mounting said cutter relative to said opening so that upon the reed being reciprocated in beating-up the filling yarn into the fabric, said cutter has yarn severing portions that are positioned in said opening in the reed during the effecting of severing of the terminal ends of the filling yarns so that the terminal ends of the filling yarn are severed within about 1/32" of the selvage of the fabric being woven.

4. In a loom of the type wherein the filling yarn is inserted into the warp shed in the form of cut lengths and wherein a reed serves for beating-up the inserted filling yarn into the fabric at the fell of the cloth, the combination therewith of improved means for severing the terminal ends of filling yarns projecting outwardly from at least one of the selvages of the fabric being woven;

said means comprising a resistance heated cutter positioned adjacent at least one end of the reed, said reed having equally spaced dents and a widthwise extending opening therein adjacent the end where said cutter is positioned, said opening being of a width substantially equivalent to three dent spaces;

means mounting said cutter relative to said opening so that upon the reed being reciprocated in beating-up the filling yarn into the fabric, said cutter has yarn severing portions that are positioned in said opening in the reed during the effecting of severing of the terminal ends of the filling yarns so that the terminal ends of the filling yarn are severed within about 1/32" of the selvage of the fabric being woven.

5. In a loom of the type wherein the filling yarn is inserted into the warp shed in the form of cut lengths and wherein a reed serves for beating-up the inserted filling yarn into the fabric at the fell of the cloth, the combination therewith of improved means for severing the terminal ends of filling yarns projecting outwardly from the selvages of the fabric being woven;

said means comprising a cutter positioned adjacent each end of the reed, said reed having a relatively wide widthwise extending opening therein adjacent each end where each respective cutter is positioned, each opening being of a width substantially greater than the dent spacing of the reed; and means mounting each of said cutters relative to each respective opening so that upon the reed being reciprocated in beating-up the filling yarn into the fabric, each of said cutters has yarn severing portions that are positioned in said openings in the reed during the effecting of severing of the terminal ends of the filling yarns so that the terminal ends of the filling yarn are severed within about 1/32" of the selvages of the fabric being woven.

6. In a loom of the type wherein the filling yarn is inserted into the warp shed in the form of cut lengths and wherein a reed serves for beating-up the inserted filling yarn into the fabric at the fell of the cloth, an improved method for severing the terminal ends of filling yarns projecting outwardly from at least one of the selvages of the fabric being woven;

said method comprising positioning a cutter adjacent at least one end of the reed, providing said reed with a relatively wide widthwise extending opening therein adjacent the end where said cutter is positioned, said opening being of a width substantially greater than the dent spacing of the reed;

reciprocating said reed and beating-up the filling yarn into the fabric while at the same time moving cutter portions of said cutter in and out of the relatively wide widthwise extending opening in the reed;

severing the terminal ends of the filling yarn close to the selvage of the fabric being woven by contacting the filling yarn with said cutter portion while such cutter portion is positioned in the wide reed opening.

7. In a loom of the type wherein the filling yarn is inserted into the warp shed in the form of cut lengths and wherein a reed serves for beating-up the inserted filling yarn into the fabric at the fell of the cloth, and improved method for severing the terminal ends of filling yarns projecting outwardly from the selvages of the fabric being woven;

said method comprising positioning a cutter adjacent each end of the reed, providing said reed with a relatively wide widthwise extending opening therein adjacent each end where each respective cutter is positioned, each opening being of a width substantially greater than the dent spacing of the reed;

reciprocating said reed and beating-up the filling yarn into the fabric, while at the same time moving cutter portions of each of said cutter in and out of each respective relatively wide widthwise extending opening in the reed;

severing the terminal ends of the filling yarns close to the selvage of the fabric being woven by contacting the filling yarns with said cutter portions while said cutter portions are positioned within respective widthwise openings.

* * * * *

UNITED STATES PATENT AND TRADEMARK OFFICE

CERTIFICATE OF CORRECTION

PATENT NO. : 4,607,667

DATED : August 26, 1986

INVENTOR(S) : Carroll A. Gibson

It is certified that error appears in the above-identified patent and that said Letters Patent is hereby corrected as shown below:

IN THE TITLE: The title should read --APPARATUS FOR SEVERING INSERTED FILLING YARNS AND METHOD--

Signed and Sealed this

Twentieth Day of January, 1987

*Attest:*

DONALD J. QUIGG

*Attesting Officer*

*Commissioner of Patents and Trademarks*